US008454021B2

(12) United States Patent
Yu

(10) Patent No.: US 8,454,021 B2
(45) Date of Patent: Jun. 4, 2013

(54) STRATEGY GAME

(75) Inventor: Brian M. Yu, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 203 days.

(21) Appl. No.: 12/902,510

(22) Filed: Oct. 12, 2010

(65) Prior Publication Data

US 2011/0084452 A1 Apr. 14, 2011

Related U.S. Application Data

(60) Provisional application No. 61/250,542, filed on Oct. 11, 2009.

(51) Int. Cl.
*A63F 3/00* (2006.01)

(52) U.S. Cl.
USPC ..... 273/271; 273/275; 273/290; 273/296; 273/267

(58) Field of Classification Search
USPC ..... 273/275, 267, 272, 290, 293, 295, 273/296, 299
See application file for complete search history.

(56) References Cited

U.S. PATENT DOCUMENTS

| | | | | | |
|---|---|---|---|---|---|
| 1,162,629 | A | * | 11/1915 | Mager | 434/159 |
| 1,399,811 | A | * | 12/1921 | Smith | 273/299 |
| 3,768,811 | A | * | 10/1973 | Goldfarb et al. | 273/261 |
| 3,784,205 | A | * | 1/1974 | Cross, Jr. | 273/242 |
| 4,903,969 | A | * | 2/1990 | Williams, Jr. | 273/248 |
| 2005/0167917 | A1 | * | 8/2005 | MacIver et al. | 273/272 |

* cited by examiner

*Primary Examiner* — Benjamin Layno
(74) *Attorney, Agent, or Firm* — Cantor Colburn LLP

(57) ABSTRACT

A strategy game is disclosed herein. The game comprises a plurality of playing pieces, a plurality of stopper tiles, and a rule set. The rule set includes a plurality of rules, where a first rule provides that a stopper tile is an edge of a game playing area when placed on a playing pieces.

8 Claims, 4 Drawing Sheets

STRATEGY GAME

CROSS REFERENCE TO RELATED APPLICATIONS

This application claims the benefit of U.S. Provisional Application No. 61/250,542 filed on Oct. 11, 2009. The disclosure of which is herein incorporated by reference in its entirety.

BACKGROUND

The present disclosure relates to a strategy game and a method of playing the game.

Many of the classic board games (i.e., chess, checkers, etc.) involve games of abstract strategy. A game of abstract strategy typically involves two players or teams playing with perfect information. In other words, all the information including the pieces or cards and the moves are available to all the players. In most cases, these games require the use of a board that defines the playing area.

It is desirable to provide a game that is portable and played without a board.

SUMMARY

A game is disclosed herein. The game comprises a plurality of playing pieces, a plurality of stopper tiles, and a rule set. The rule set includes a plurality of rules, where a first rule provides that a stopper tile is an edge of a game playing area when placed on a playing piece. In one embodiment, the playing pieces may be cards.

A method of playing a game is further disclosed here. The method of playing the game comprises distributing playing pieces or cards to players; distributing stopper tiles to players; laying the playing pieces or cards on a game playing area based on abstract strategy; defining an edge of the game playing area during game play using the stopper tiles; and awarding a winner based on the laid playing pieces or cards.

BRIEF DESCRIPTION OF THE DRAWINGS

Other features, advantages and details appear, by way of example only, in the following description of embodiments, the description referring to the drawings in which.

DETAILED DESCRIPTION

Figure 1:
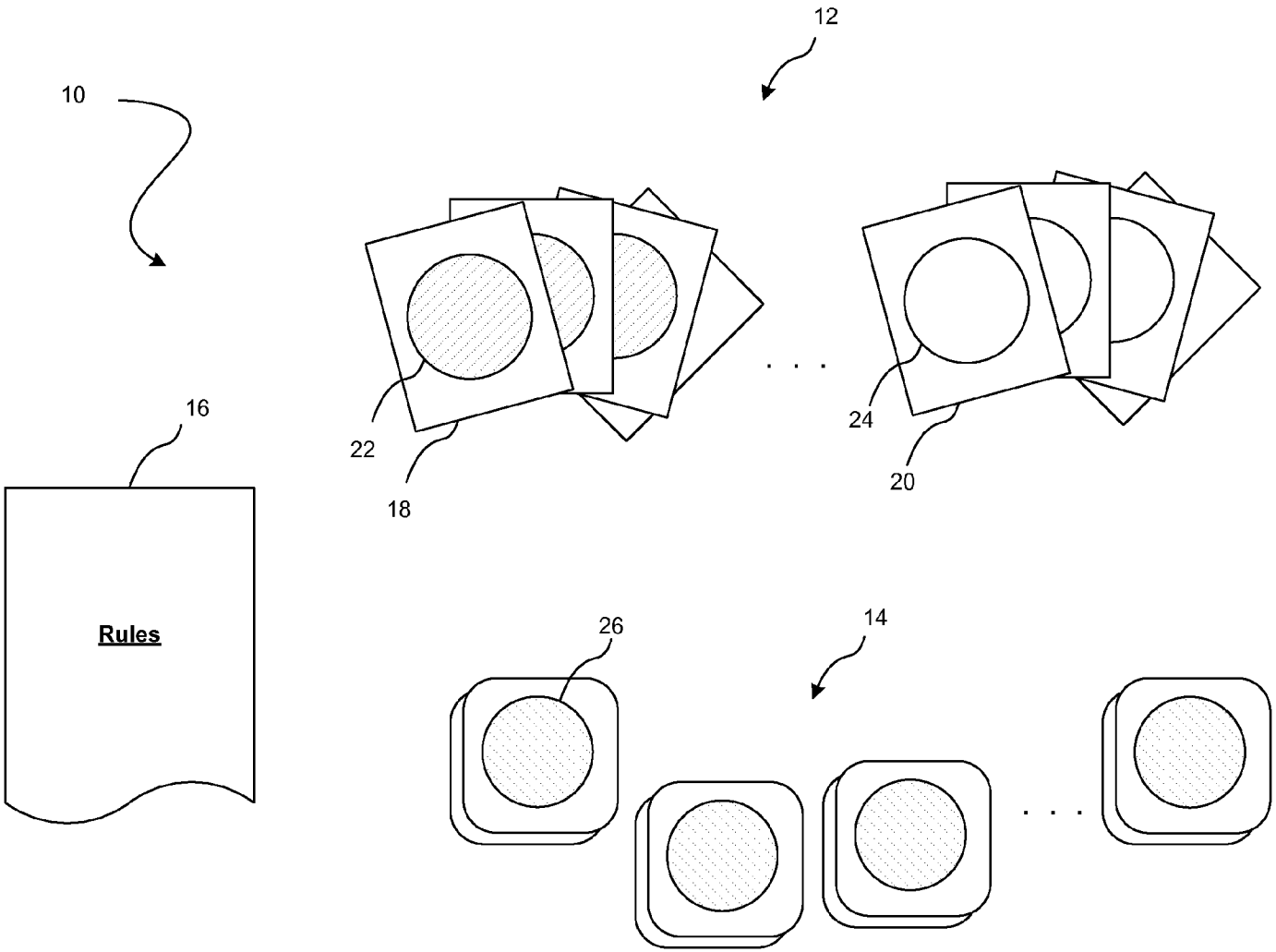
FIG. 1 is an illustration of a strategy game according to various embodiments of the present invention.

The following description is merely exemplary in nature and is not intended to limit the present disclosure, application, or uses. It should be understood that throughout the drawings, corresponding reference numerals indicate like or corresponding parts and features.

Referring now to FIG. 1, where the invention will be described with reference to specific embodiments without limiting same, an exemplary strategy game is shown generally at 10. The strategy game 10 includes a plurality playing cards 12 (e.g., fifty playing cards, or any other amount), a plurality of stopper tiles 14 (e.g., ten stopper tiles, or any other amount), and a rule set 16. The strategy game 10 can be played using the playing cards 12 and the stopper tiles 14 according to abstract strategy, where all players make moves and all players are aware of all the moves. According to various embodiments of the present invention, any playing surface may be used as a game playing area. During game play, the stopper tiles 14 are used to define a portion of the edges or boundaries of the game playing area. In various embodiments, play cannot extend beyond the edge or boundary. It is to be further understood that while in the described embodiment the playing pieces 12 consist of cards, the described invention is not so limited and is instead intended to encompass playing pieces of any suitable size, shape, or material.

In one non-limiting exemplary embodiment, the playing cards 12 can comprise a synthetic or organic material and can be square or rectangular in shape. In one example, each playing card 12 is square and has dimensions of 2.25 inches by 2.25 inches, dimensions that are easily grasped by a player. Of course, any size and configuration is contemplated to be within the exemplary embodiments of the present invention. Each playing card 12 includes a first playable side 18 and a second playable side 20 that is the opposite side of the first playable side 18. In various embodiments, the first playable side 18 of each playing card 12 includes a first illustration or marking 22. In one example, the illustration or marking 22 (hereinafter referred to as a marking 22) includes a circle or disk according to a first color or pattern (e.g., a black disk, or any other color and shape configuration). The second playable side 20 of each playing card 12 similarly includes a second illustration or marking 24. In one example, the illustration or marking 24 (hereinafter referred to as a marking 24) includes a circle or disk according to a second color or pattern (e.g., a white disk, or any other color and shape configuration).

The plurality of stopper tiles 14 can comprise synthetic or natural, organic material and can be rectangular, circular, or square in shape. In one example, each stopper tile 14 is a square disk and has dimensions of 0.9 inches by 0.9 inches by 0.45 inches, dimensions that are easily grasped by a player. Of course, any size and configuration is contemplated to be within the exemplary embodiments of the present invention. In various embodiments, the stopper tiles 14 are a third color or pattern (e.g., a red disk or any other color and shape configuration). In various other embodiments, the stopper tiles 14 include an illustration or marking 26. In one example the illustration or marking 26 (hereinafter referred to as a marking 26) includes a circle according to the third color or pattern (e.g., red circle).

The rule set 16 includes a plurality of rules that define the game that can be played with the playing cards 12 and the stopper tiles 14. The rules, for example, define the game operations that can be performed with each playing card 12, define the game operations that can be performed with each stopper tile 14, define the order of the game operations, and/or define the determination of a winner of the game.

In one example, rules of the playing cards 12 are shown in the following Table 1.

TABLE 1

| | |
|---|---|
| 1 | The playing cards can be evenly divided amongst the players. |
| 2 | Each marking (e.g., white disk, and black disk) of the playing cards can be assigned to a single player. |

TABLE 1-continued

| | |
|---|---|
| 3 | One playing card may be laid per turn. |
| 4 | The playing card can be laid with the corresponding player's marking face up. |
| 5 | The playing card can be laid in a position that is in line (horizontal, vertical, diagonal) with a laid playing card that shows the same marking face up. |
| 6 | A laid card may be flipped to show the opposite marking face up, once the laid card has been flanked by two laid cards having the opposite marking. |
| 7 | A playing card may not be laid next to a card having a stopper tile. |

In another example, rules of the stopper tiles 14 are shown in the following Table 2.

TABLE 2

| | |
|---|---|
| 1 | The stopper tiles can be evenly divided amongst the players. |
| 2 | One stopper tile may be laid per turn. |
| 3 | The stopper tile can be laid on top of any recently laid playing card. |
| 4 | The stopper tile, once laid, defines an edge of the game playing area. |

In another example, rules of game play are shown in the following Table 3.

TABLE 3

| | |
|---|---|
| 1 | The game may be played with two players. |
| 2 | Any playing surface may become the game playing area. |
| 3 | Game play begins with each player laying two cards on the playing surface with their assigned marking face up, and according to the following format:<br>XO<br>OX. |
| 4 | Players play the playing cards according to the rules of the playing cards. |
| 5 | Players may play the stopper tiles according to the rules of the stopper tiles. |
| 6 | Game play ends when all playing cards have been laid. |
| 7 | A winner is determined based on the number of markings face up, where the player having the most markings face up wins. |

Figure 2D:
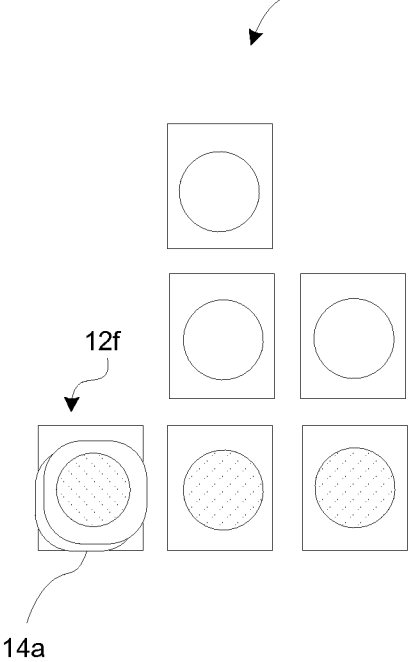
FIGS. 2A-2D is illustrations of various game play using the strategy game according to various embodiments of the present invention.
Figure 2C:
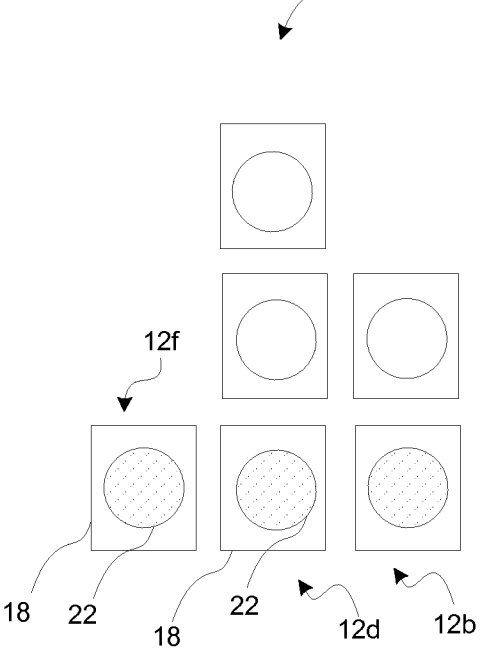
Figure 2B:
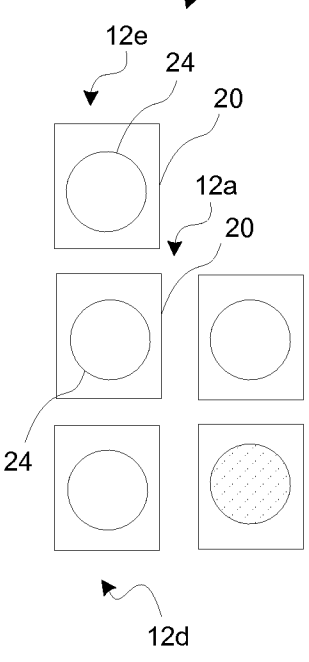
Figure 2A:
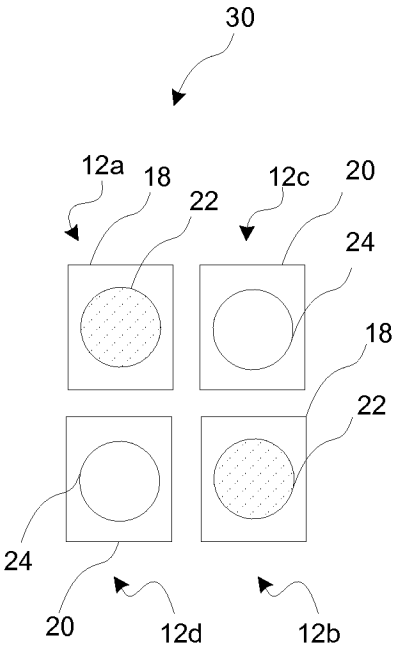

Referring now to FIGS. 2A-2D, illustrations of game play using the playing cards 12 and the stopper tiles 14 based on the rule set 16 are shown. In FIG. 2A an initial play 30 of the game according to the game play rule 3 (see Table 3) is shown. Four playing cards 12*a*-12*d* are laid on a playing surface (the game playing area). Two playing cards 12*a*, 12*b* of the four playing cards 12*a*-12*d* are laid with the first playable side 18 face up, showing the first marking 22; and the other two playing cards 12*c*, 12*d* of the four playing cards 12*a*-12*d* are laid with the second playable side 20 face up, showing the second marking 24.

In FIGS. 2B-2D, subsequent plays 32-36 of the game are shown. In FIG. 2B, for example, a playing card 12*e* is laid with the second playable side 20 face up and in line with the playing card 12*d* having the second playable side 20 face up according to the playing card rules 2 through 5 (see Table 1). The playing card 12*a* is then flipped to show the second playable side 20 face up according to the playing card rule 6 (see Table 1).

In FIG. 2C, for example, a playing card 12*f* is laid with the first playable side 18 face up and in line with the playing card 12*b* having the first playable side 18 face up according to the playing card rules 2 through 5 (see Table 1). The playing card 12*d* is then flipped to show the first playable side 18 face up according to the playing card rule 6 (see Table 1).

In FIG. 2D, for example, a stopper tile 14*a* is laid on top of the playable card 12*f* according to the stopper tile rules 2 and 3 (see Table 2) thus, designating the playable card 12*f* as an edge according to the stopper tile rule 4 (see Table 2).

Figure 3:
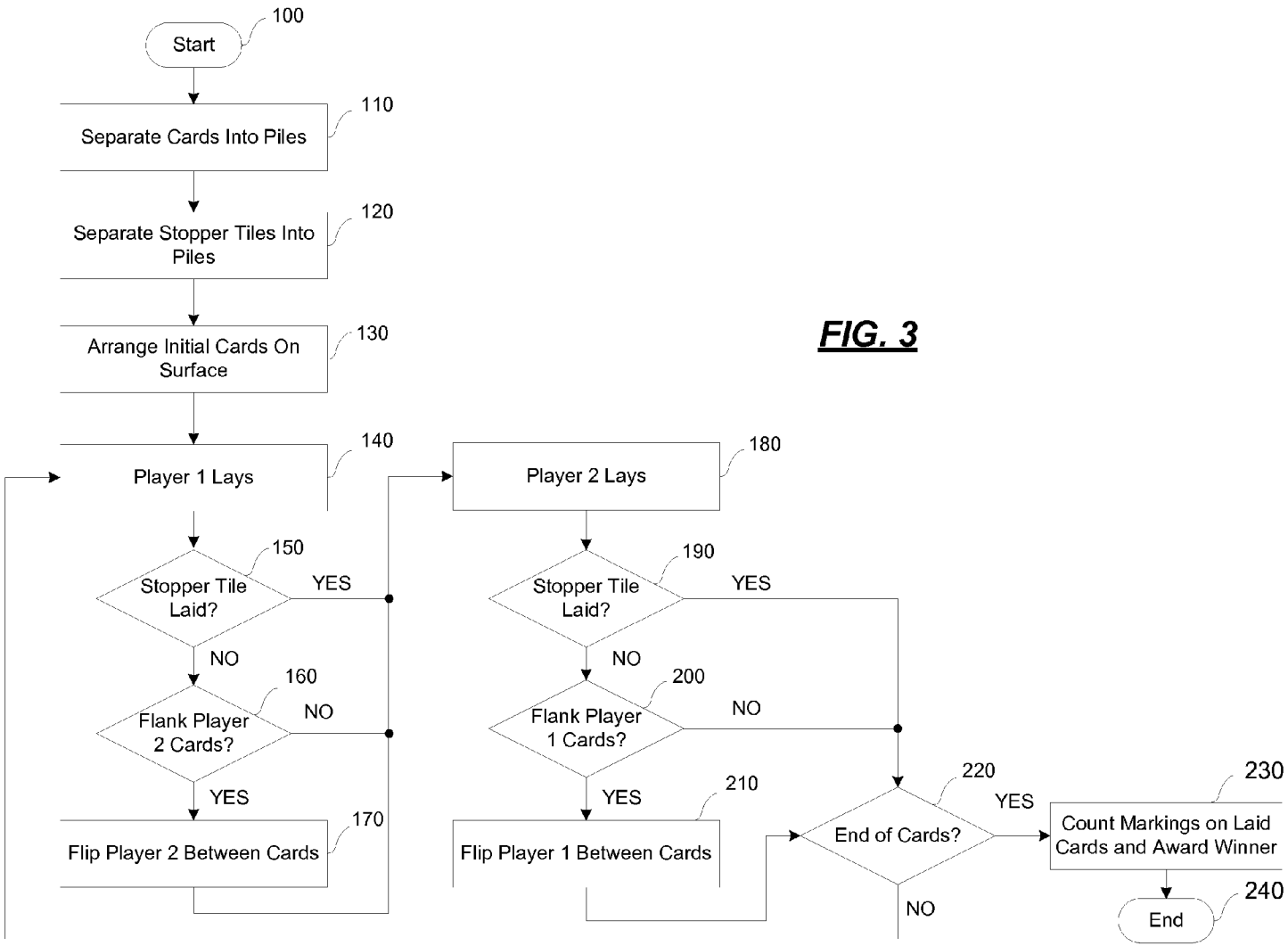
FIG. 3 is a flowchart illustrating a method of playing a strategy game according to various embodiments of the present invention.

Referring now to FIG. 3 and with continued reference to FIGS. 1 and 2, a flowchart illustrates a method of playing the card game 10. As can be appreciated in light of the disclosure, the order of operation within the method is not limited to the sequential execution as illustrated in FIG. 3, but may be performed in one or more varying orders as applicable and in accordance with the present disclosure.

In one example, the method may begin at 100. The playing cards 12 may be separated into two piles, one pile for each player at 110. The stopper tiles 14 may be separated into two piles, one pile for each player at 120. Play begins at 130 where each player lays their initial two playing cards 12 on a playing surface with their marking 22 or 24 face up (as shown in, for example, the initial play 30 of FIG. 2A).

Play continues at 140 to 230. Player one then plays his turn at 140 either by laying a playing card 12 adjacent to a laid playing card 12 with the appropriate marking 22 or 24 face up or by laying a stopper tile 14 on top of a laid playing card 12. If a stopper tile 14 is laid at 150, play continues with player two's turn at 180. However, if a stopper tile 14 is not laid at 150, rather a playing card 12 is laid; the position of the laid playing card 12 is evaluated at 160. If the laid playing card 12 does not cause one or more of player two's playing cards 12 to be flanked at 160, play continues with player two's turn at 180. However, if the laid playing card 12 causes one or more of player two's playing cards 12 to be flanked at 160, the laid playing cards 12 between the flank are flipped to show player one's marking at 170. Play then continues at 180 with player two's turn.

At 180, player two then plays her turn either by laying a playing card 12 adjacent to a laid playing card 12 with the appropriate marking 22 or 24 face up or by laying a stopper tile 14 on top of a laid playing card 12. If a stopper tile 14 is laid at 190, play continues by evaluating the number of playing cards 12 left at 220. However, if a stopper tile 14 is not laid at 190, rather a playing card 12 is laid; the position of the laid playing card 12 is evaluated at 200. If the laid playing card 12 does not cause one or more of player one's playing cards 12 to be flanked at 200, play continues by evaluating the number of playing cards 12 left at 220. However, if the laid card causes one or more of player one's playing cards 12 to be flanked at 200, the laid playing cards 12 between the flank are flipped to show player two's marking 22 or 24 at 210. Play then continues at 220 by evaluating the number of playing cards 12 left.

If, at 220, player one and/or player two has playing cards 12 left in their pile, play continues at 140-210. However, if all the playing cards 12 have been laid at 220, the markings 22 and 24 on the laid playing cards 12 are counted and the winner is awarded at 230. In one example, the winner is awarded to the player with the most markings 22 or 24 showing. Thereafter, the method may end at 240.

Figure 4:
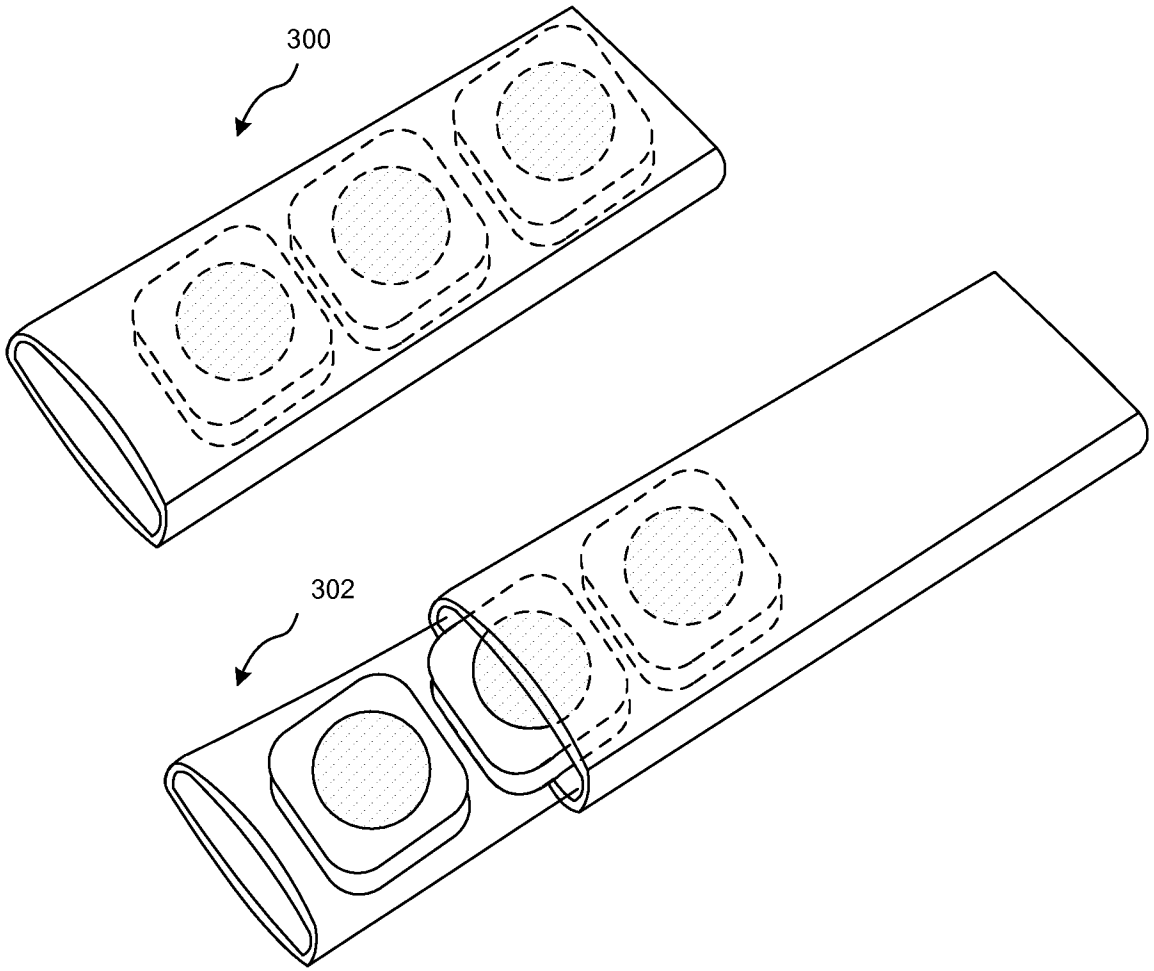
FIG. 4 illustrates a non-limiting packaging configuration for use with various embodiments of the present invention.

In one exemplary embodiment the cards or playing pieces are provided in convenient packaging 300 wherein a carrier tray 302 is configured to receive the playing cards and stopper tiles therein and wherein the carrier tray is configured to slide into and out of an exterior package that allows for access to the game pieces. In addition the exterior packaging provides for a protective covering and storage of the game within the exterior package. One non-limiting package configuration is illustrated in FIG. 4.

In accordance with exemplary embodiments the disclosed game can use any surface as its game board. Therefore, there is no predefined "edge" but the players can create their own "edge" by using the stopper tiles. On a player's turn, they must play a card that outflanks 1 or more of their opponent's cards. All cards outflanked are turned to color of the active player. The active player may decide to use 1 of their 5 stopper tiles and place it on their newly played card. Any card that has a stopper tile on top of it cannot be flipped. Cards with stopper tiles also prohibit outflanking by an opponent. When both players have played all their cards, the player with the most cards in their color wins. In various exemplary embodiments, the stopper tiles may be played at any time during a player's turn or only on a new card a player is laying down during their turn. Moreover and in one embodiment, the stopper tiles may only be used once thus each player only has a finite amount of stopper cards they can play during a game.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A game, comprising:

a plurality of playing cards, wherein each playing card has a first side and a second side, and wherein the first side includes a first marking and the second side includes a second marking, the first marking being different from the second marking;

a plurality of stopper tiles, wherein each stopper tile has a third marking, the third marking being different from the first marking and the second marking; and a rule set that includes a plurality of rules, wherein a first rule of the plurality of rules provides that the plurality of playing cards be sequentially placed next to each other so that either the first marking or the second marking of each of the plurality of playing cards is viewable; wherein a second rule of the plurality of rules allows one of the plurality of stopper tiles to be placed upon one of the plurality of playing cards that has been placed next to another one of the plurality of cards; and wherein a third rule of the plurality of rules prevents one of the plurality of playing cards from being placed next to one of the plurality of cards having the stopper tile previously placed thereon.

2. The game of claim 1 wherein the first marking displays a first color, and wherein the second marking displays a second color.

3. The game of claim 2 wherein the third marking is a third color.

4. The game of claim 1 wherein the plurality of stopper tiles are at least one of square, rectangular, and circular tiles.

5. The game of claim 1 wherein a fourth rule of the plurality of rules provides that one stopper tile is selectively laid per turn.

6. The game of claim 1 wherein a fourth rule of the plurality of rules provides that the stopper tile is laid on a recently laid playing card.

7. The game of claim 1 wherein a fourth rule of the plurality of rules provides that plurality of stopper tiles are divided evenly amongst players.

8. The game of claim 1 wherein a fourth rule of the plurality of rules provides that a winner of the game is determined by calculating the number of cards showing the first marking and the number of cards showing the second marking when no more cards may be placed next to each other; and determining a winner of the game based upon a greater number of cards showing the first marking or the second marking.

* * * * *